US006858819B2

(12) United States Patent
McWilliams

(10) Patent No.: US 6,858,819 B2
(45) **Date of Patent: *Feb. 22, 2005**

(54) ELECTRIC HEATING ELEMENT

(75) Inventor: Kevin Ronald McWilliams, Stratford upon Avon (GB)

(73) Assignee: Ceramaspeed Limited (GB)

( * ) Notice: Subject to any disclaimer, the term of this patent is extended or adjusted under 35 U.S.C. 154(b) by 0 days.

This patent is subject to a terminal disclaimer.

(21) Appl. No.: 10/462,119

(22) Filed: Jun. 13, 2003

(65) Prior Publication Data

US 2004/0040949 A1 Mar. 4, 2004

(30) Foreign Application Priority Data

Jun. 19, 2002 (GB) ..... 0214038

(51) Int. Cl.[7] ..... F24C 7/04; A21B 1/14; A21B 3/04

(52) U.S. Cl. ..... 219/409; 219/402; 219/391; 219/400; 219/408

(58) Field of Search ..... 219/391, 400, 219/402, 404, 408, 411, 526, 536, 542, 548, 409

(56) References Cited

U.S. PATENT DOCUMENTS

| | | | | |
|---|---|---|---|---|
| 2,658,742 A | | 11/1953 | Suter et al. | |
| 3,786,778 A | * | 1/1974 | Burstein et al. | 219/400 |
| 5,388,177 A | | 2/1995 | Ono et al. | |
| 5,526,462 A | * | 6/1996 | Kondo et al. | 219/536 |
| 6,100,503 A | * | 8/2000 | Sasaki et al. | 219/411 |
| 6,437,294 B2 | * | 8/2002 | Allera et al. | 219/393 |

FOREIGN PATENT DOCUMENTS

| | | | |
|---|---|---|---|
| DE | 3636622 | | 5/1988 |
| EP | 0398658 | | 11/1990 |
| GB | 1130803 | | 11/1967 |
| JP | 02302527 A | * | 12/1990 |
| JP | 090007740 | | 1/1997 |

OTHER PUBLICATIONS

United Kingdom Search Report Dec. 19, 2002.

* cited by examiner

*Primary Examiner*—Joseph Pelham
(74) *Attorney, Agent, or Firm*—Ira S. Dorman

(57) ABSTRACT

An electric heating element (10) for an oven (2) is provided at least in part with a coating (14) of a catalyst means.

29 Claims, 5 Drawing Sheets

ELECTRIC HEATING ELEMENT

This invention relates to an electric heating element for use in an oven, for example for performing a grilling or other cooking operation.

BACKGROUND TO THE INVENTION

More particularly, the invention relates to an electric heating element for an oven in which smoke or fumes are generated in a cavity of the oven and are treated by a catalyst assembly for exit from the oven cavity through a flue arrangement which is provided to vent the oven cavity.

DESCRIPTION OF PRIOR ART

It is well known to provide a catalyst assembly in the flue of an oven to reduce or eliminate smoke or fumes generated either during a normal cooking operation, or during a high temperature self-cleaning cycle effected in the oven. Such a catalyst assembly requires to be heated to a high temperature of at least 200 degrees Celsius before it can operate efficiently. This is usually attempted by locating the catalyst assembly in the flue arrangement sufficiently close to the outlet from the oven that hot air from the oven heats the catalyst assembly. However, heating up of the catalyst assembly can be insufficiently rapid, leading to release of undesirable smoke or fumes from the oven. In another arrangement, a separate heating element, such as of metal-sheathed form, is known to be provided up-stream of the catalyst assembly to more rapidly heat the air approaching the catalyst assembly. Such an arrangement is expensive to implement.

It is also known to locate a heating element near a top wall of an oven cavity, with part of the element overlying a flue opening provided in the top wall of the oven cavity, a catalyst assembly being provided in the flue. This can improve the heat-up rate of air entering the flue and thus accelerate heating of the catalyst assembly. However, the heating element and the catalyst assembly are provided as separate components and subsequently mounted relative to the flue. Such an arrangement is inconvenient to implement.

OBJECT OF THE INVENTION

It is an object of the present invention to overcome or minimise the aforementioned disadvantages.

SUMMARY OF THE INVENTION

According to the present invention there is provided an electric heating element for an oven, the electric heating element being provided at least in part with a coating of a catalyst means.

The electric heating element may be adapted for a cooking purpose, such as grilling.

The electric heating element may be provided in a dish-like support, such as of metal, to form an electric heater for location in the cavity of the oven. A base layer of thermal insulation material, such as microporous thermal insulation material, may be arranged in the dish-like support, the heating element being supported on or adjacent to the base layer.

The dish-like support may be provided with an aperture in a face thereof and the base layer of thermal insulation material may have an opening therein coinciding with the aperture in the dish-like support.

The electric heating element may be arranged with at least one part thereof traversing the opening in the base layer coinciding with the aperture in the dish-like support, the aperture being provided in the base of the dish-like support. A supporting member, such as of ceramic material, may be arranged in the opening in the base layer for supporting the at least one part of the electric heating element traversing the opening in the base layer. Such supporting member may be moulded into, or pressed into, the base layer of thermal insulation material.

At least one apertured member may be provided, overlying the dish-like support and spaced from the heating element and permeable to smoke or fumes generated in the cavity of the oven. Such apertured member(s) may overlie a peripheral wall of the dish-like support and may comprise woven glass or ceramic fibre or filament material, and/or wire mesh material.

The catalyst means may be selected from platinum, palladium, osmium, iridium, ruthenium, rhodium and mixtures thereof.

The electric heating element may be of ribbon, wire, foil or lamp form, or of metal-sheathed form or quartz- or silica-sheathed form.

According to another aspect of the present invention there is provided an oven including a cavity, a heating element provided in the cavity and a flue arrangement for venting the cavity, the heating element being provided at least in part with a coating of a catalyst means.

The electric heating element may be provided at at a wall of the cavity, which may be a top wall. The flue arrangement may be provided with a fan arrangement.

The electric heating element may be arranged for location in singularity or in plurality in the cavity of the oven. The catalyst means may be adapted to reduce or eliminate passage into the flue arrangement of smoke or fumes generated in the cavity of the oven.

The electric heating element may be arranged for location in the cavity of the oven adjacent to or overlying the flue arrangement.

The coating of the catalyst means may be provided on at least a part of the heating element adjacent to or overlying the flue arrangement.

The electric heating element may be provided in a dish-like support, such as of metal, to form an electric heater for location in the cavity of the oven. The dish-like support may have a first face arranged to be open to the cavity of the oven and a second face having an aperture for interfacing with the flue arrangement.

The aperture in the dish-like support may be provided in the second face of the dish-like support comprising a base or a peripheral wall of the dish-like support.

A base layer of thermal insulation material, such as microporous thermal insulation material, may be arranged in the dish-like support, the heating element being supported on or adjacent to the base layer.

The base layer of thermal insulation material may have an opening therein coinciding with the aperture in the dish-like support.

The electric heating element may be arranged with at least one part thereof traversing the opening in the base layer coinciding with the aperture in the dish-like support, when the aperture is provided in the base of the dish-like support.

A supporting member, such as of ceramic material, may be arranged in the opening in the base layer for supporting the at least one part of the electric heating element traversing the opening in the base layer. Such supporting member may be moulded into, or pressed into, the base layer of thermal insulation material.

At least one apertured member may be provided, overlying the first face of the dish-like support and spaced from the heating element and permeable to smoke or fumes generated in the cavity of the oven. Such apertured member(s) may overlie a peripheral wall of the dish-like support and may comprise woven glass or ceramic fibre or filament material, and/or wire mesh material.

The catalyst means may be selected from platinum, palladium, osmium, iridium, ruthenium, rhodium and mixtures thereof.

The electric heating element may be of ribbon, wire, foil or lamp form, or of metal-sheathed form or quartz- or silica-sheathed form.

Because the catalyst means is provided as a coating on the electric heating element, the catalyst means is heated rapidly to a high temperature essential for its operation and therefore efficiently reduces or eliminates smoke or fumes generated in the cavity of the oven and prevents or minimises exit thereof through the flue arrangement of the oven.

For a better understanding of the present invention and to show more clearly how it may be carried into effect, reference will now be made, by way of example, to the accompanying drawings in which:

DESCRIPTION OF PREFERRED EMBODIMENTS

Figure 1:
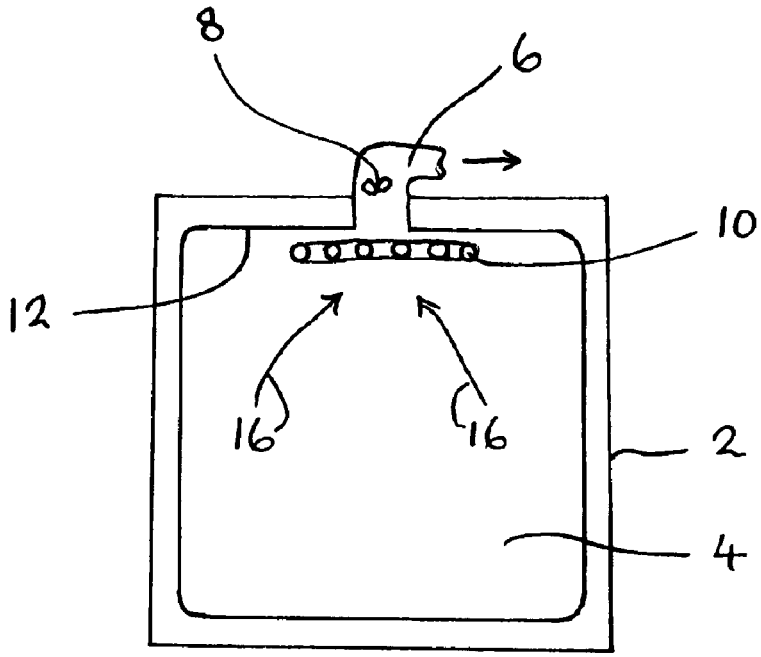
FIG. 1 is a cross-sectional view of an oven provided with an embodiment of an electric heating element according to the present invention.

Referring to FIG. 1, an oven 2, such as for cooking food, for example by grilling, has a cavity 4. A flue arrangement 6 is provided for venting the cavity 4 and may be provided with a fan 8 for promoting exit of air from the cavity 4 through the flue arrangement 6.

Figure 2:
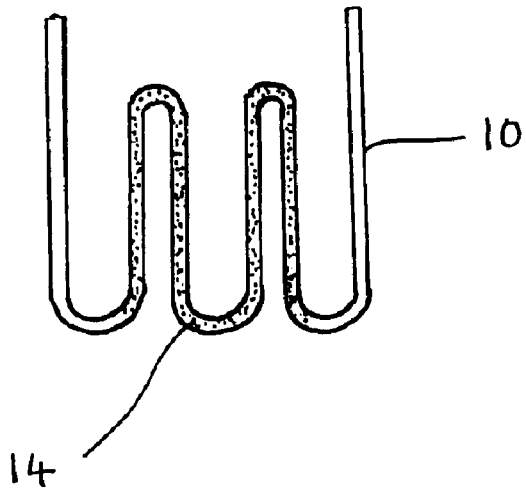
FIG. 2 is a plan view of the electric heating element provided in the oven of FIG. 1.

An electric heating element 10 is supported at a top wall 12 of the cavity 4, overlying the flue arrangement 6. As shown particularly in FIG. 2, the heating element 10 is of well-known metal-sheathed form. The heating element 10 is distinguished by being provided with a coating 14 of a catalyst means. The coating 14 of the catalyst means is applied directly to the heating element and can be provided over substantially the entire surface of the heating element 10, but this is not essential. The coating 14 of the catalyst means is particularly provided on that part of the heating element 10 overlying or adjacent to the flue arrangement 6.

The coating 14 of the catalyst means is arranged to be active, when heated to at least 200 degrees Celsius, to act on smoke or fumes 16 generated in the oven cavity 4 and eliminate or reduce passage of smoke or fumes through the flue arrangement 6. Because the coating 14 of the catalyst means is provided directly on the surface of the heating element 10, it heats up rapidly when the heating element 10 is energised, such as for a cooking operation, and is almost immediately effective to deal with the smoke or fumes 16 generated during a cooking operation or during a high temperature self-cleaning cycle effected in the cavity 4.

The coating 14 of the catalyst means suitably comprises platinum, palladium, osmium, iridium, ruthenium, rhodium and mixtures thereof.

Figure 3:
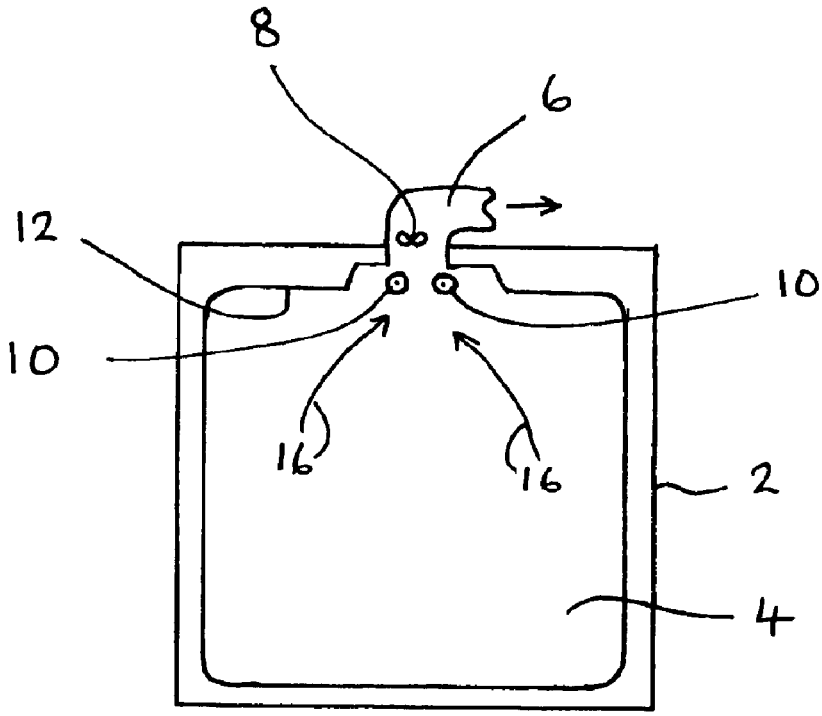
FIG. 3 is a cross-sectional view of an oven provided with another embodiment of electric heating elements according to the present invention.
Figure 4:
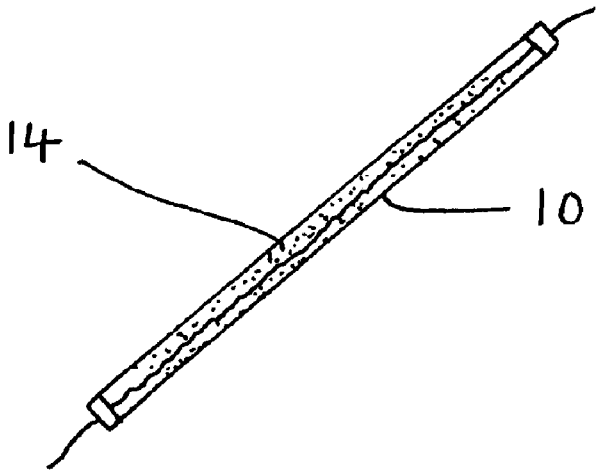
FIG. 4 is a perspective view of one of the heating elements provided in the oven of FIG. 3.

Referring to FIG. 3, this shows an oven 2 similar to that of FIG. 1, having a cavity 4, flue arrangement 6, optional fan 8 and a heating element 10. However, as particularly shown in FIG. 4, the heating element arrangement 10 comprises one or more heating lamps, such as quartz-halogen lamps, or one or more quartz or silica tubes enclosing an electrical resistance heating wire. The heating element arrangement 10 is supported at a top wall 12 of the cavity 4 of the oven, overlying the flue arrangement 6. At least part of the outer surface of the heating element arrangement 10, comprising the one or more heating lamps or the one or more quartz or silica tubes enclosing the heating wire, is provided with a coating 14 of catalyst means of substantially the same form as that previously described with reference to the heating element 10 of FIGS. 1 and 2. The coating 14 of the catalyst means is heated by the heating element arrangement 10, when the heating element arrangement 10 is energised, and acts in the same way as described with reference to FIG. 1 to reduce or eliminate exit through the flue arrangement 6 of smoke or fumes 16 generated in the oven cavity 4.

Figure 5:
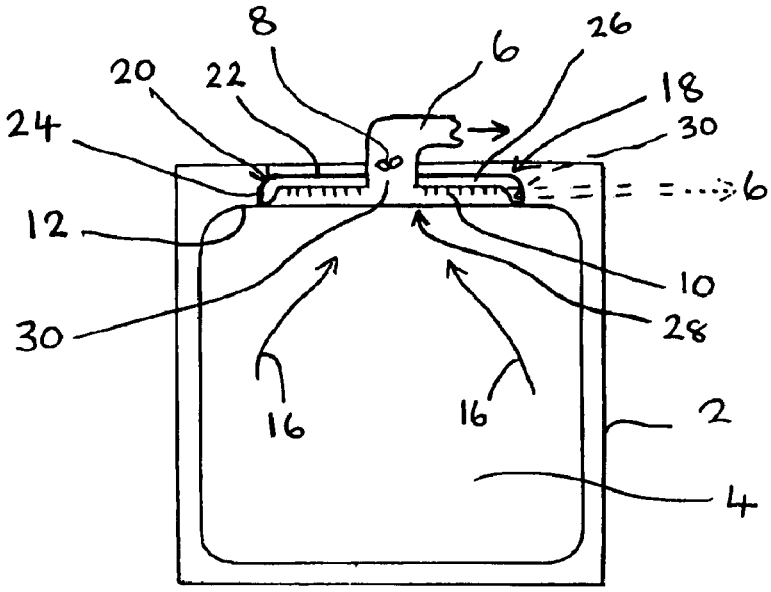
FIGS. 5 and 6 are cross-sectional views of an oven provided with alternative locations of an electric heater provided with an embodiment of a heating element according to the present invention.
Figure 6:
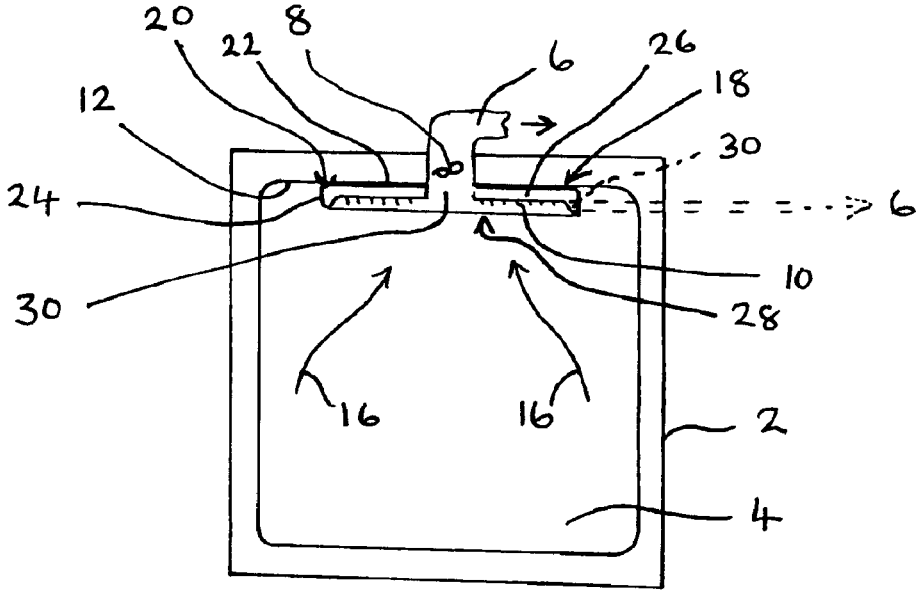
Figure 7:
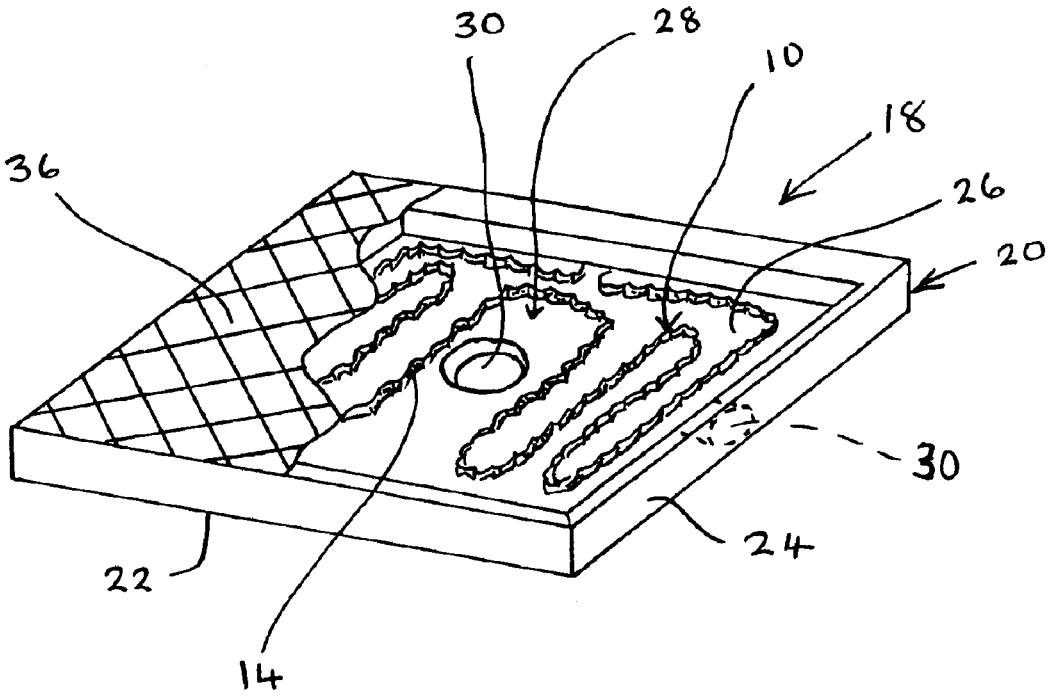
FIG. 7 is a perspective view of the heater provided in the oven of FIGS. 5 and 6.

Referring now to FIGS. 5 to 7, a radiant electric heater 18 is located in an oven 2, similar to the ovens 2 of FIGS. 1 and 3. The heater 18 is located in the oven 2 intermediate the cavity 4 of the oven and the flue arrangement 6 provided with the optional fan 8.

The oven 2 of FIG. 5 has the heater 18 located at the top of the oven cavity 4 in a recess in the top wall 12 of the cavity 4, whereas the oven 2 of FIG. 6 has the heater 18 located at the top of the oven cavity 4, inside the cavity 4 and against the top wall 12 thereof.

The heater 18 is arranged in the oven 2 between the cavity 4 of the oven and the flue arrangement 6 and comprises a dish-like support 20, such as of metal, having a base 22 and a peripheral wall 24. A base layer 26 of thermal insulation material, such as microporous thermal insulation material, is provided inside the dish-like support 20. At least one electric heating element 10 is supported on or adjacent to the base layer 26. Such heating element or elements 10 can comprise any of the well-known forms, such as ribbon, wire, foil, lamp or metal-sheathed forms, or combinations thereof. As particularly illustrated in FIG. 7, the heating element 10 may be provided of corrugated ribbon form.

The heating element or elements 10 is or are provided at least in part with a coating 14 of a catalyst means. Such coating 14 of the catalyst means is substantially the same as the coating 14 previously described with reference to the heating element 10 of FIG. 2.

The heater 18 has a front face 28 open to the oven cavity 4 and has an aperture 30 extending through the base 22 of the dish-like support 20 and the base layer 26, and interfacing with the flue arrangement 6.

When the heating element or elements 10 is or are energised, the coating 14 of the catalyst means thereon is rapidly heated to its active temperature and operates to reduce or eliminate exit through the flue arrangement 6 of smoke or fumes 16 generated in the oven cavity 4 and passing into the heater 18.

Instead of the aperture 30 being provided through the base 22 of the dish-like support 20, it could be provided through the peripheral wall 24 of the dish-like support 20, as indicated by the broken lines in FIGS. 5 to 7. With such an arrangement, the flue arrangement 6 suitably extends from the peripheral wall 24 rather than the base 22 of the dish-like support 20.

The coating 14 of the catalyst means can be provided over substantially the entire surface of the heating element or elements 10. However, this is not essential and the coating 14 could be confined to one or more regions of the heating element or elements 10, such as overlying or adjacent to the aperture 30 in the dish-like support 20.

Figure 8:
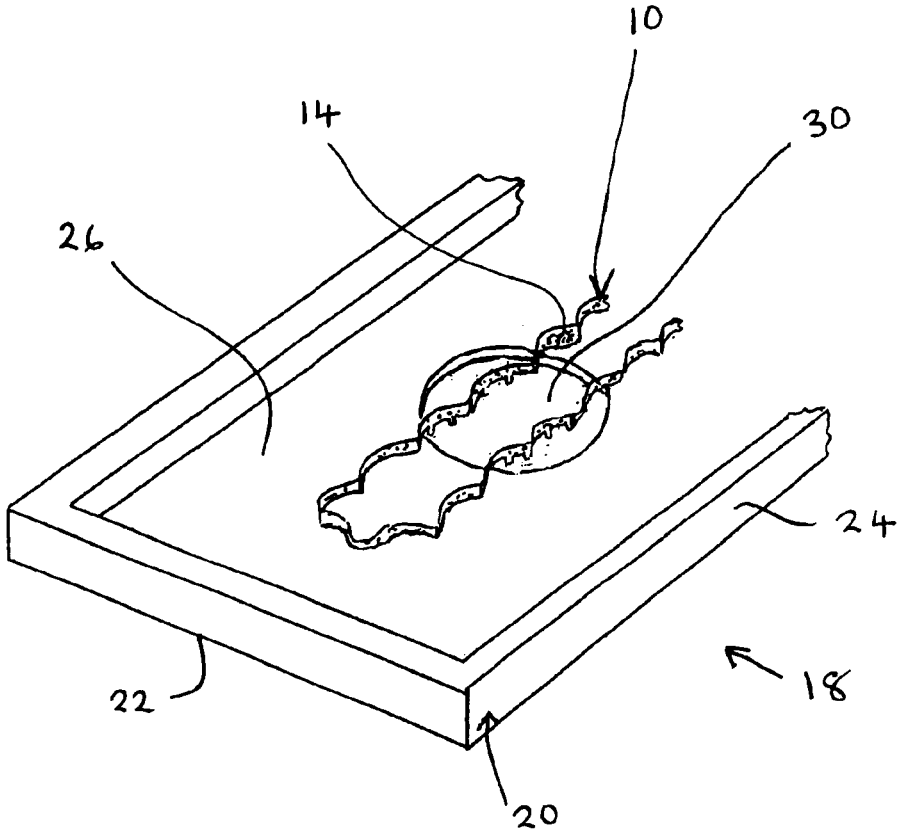
FIG. 8 is a perspective view of an alternative arrangement of the heating element in the heater of FIG. 7.
Figure 9A:
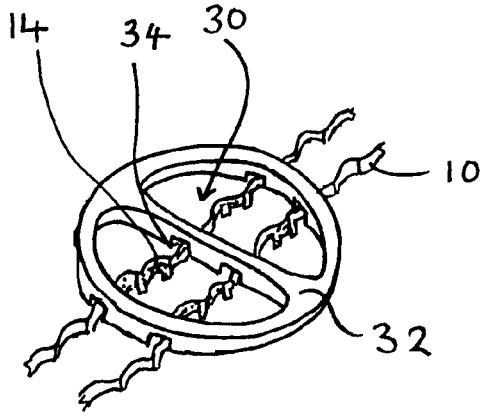
FIGS. 9A and 9B are perspective views of embodiments of supporting members for use in the arrangement of FIG. 8.
Figure 9B:
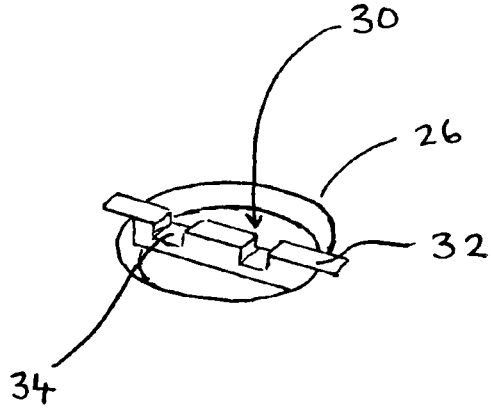

Reference is now made to FIG. 8. In order to ensure that air passing through the heater 18, and through the aperture 30 in the base 22 thereof to the flue arrangement 6, is treated as effectively as possible, at least one part of the heating element or elements 10, provided with the coating 14 of the catalyst means, is arranged to traverse the aperture 30. To prevent sagging of the at least one part of the heating element or elements 10 where crossing the aperture 30, a support member 32, such as of ceramic material, can be provided, as shown in FIGS. 9A and 9B. In FIG. 9A, the support member 32 is in the form of a frame arranged in the aperture 30 in the heater 18 and provided with recesses 34 for receiving and supporting the part or parts of the heating element or elements 10. In FIG. 9B, the support member 32 is in the form of a beam across the aperture 30 in the heater 18 and provided with recesses 34 for receiving and supporting the part or parts of the heating element or elements 10. The support members 32 of FIGS. 9A and 9B may be moulded into, or pressed into, the base layer 26 of thermal insulation material.

As shown in FIG. 7, the electric heater 18 can be provided with at least one apertured member 36, overlying the front face 28 of the heater 18 and spaced from the heating element or elements 10. Such one or more apertured members 36 is or are arranged to be permeable to smoke and/or fumes generated in the oven cavity 4 and suitably overlie(s) the peripheral wall 24 of the dish-like support 20 of the heater 18. The one or more apertured members suitably comprise (s) woven glass or ceramic fibre or filament material and/or wire mesh material.

I claim:

1. An electric heater for location in a cavity of an oven, the heater comprising a dish-like support having an electric heating element provided therein, the electric heating element being provided at least in part with a coating of a catalyst means.

2. The heater of claim 1, wherein a base layer of thermal insulation material is arranged in the dish-like support, the heating element being supported on or adjacent to the base layer.

3. The heater of claim 2, wherein the thermal insulation material comprises microporous thermal insulation material.

4. The heater of claim 2, wherein the dish-like support is provided with an aperture in a face thereof and the base layer of thermal insulation material has an opening therein coinciding with the aperture in the dish-like support.

5. The heater of claim 4, arranged with at least one part of the heating element traversing the opening in the base layer coinciding with the aperture in the dish-like support, the aperture being provided in the base of the dish-like support.

6. The heater of claim 5, wherein a supporting member is arranged in the opening in the base layer for supporting the at least one part of the electric heating element traversing the opening in the base layer.

7. The heater of claim 6, wherein the supporting member comprises ceramic material.

8. The heater of claim 6, wherein the supporting member is moulded into, or pressed into, the base layer of thermal insulation material.

9. The heater of claim 1, wherein at least one apertured member is provided, overlying the dish-like support and spaced from the heating element and permeable to smoke or fumes generated in the cavity of the oven.

10. The heater of claim 9, wherein the at least one apertured member overlies a peripheral wall of the dish-like support.

11. The heater of claim 10, wherein the at least one apertured member comprises a material selected from woven glass filament material, woven ceramic filament material, wire mesh material, and mixtures thereof.

12. The heater of claim 1, wherein the catalyst means is selected from platinum, palladium, iridium, osmium, ruthenium, rhodium and mixtures thereof.

13. The heater of claim 1, wherein the heating element is selected from ribbon form, wire form, foil form, lamp form, metal-sheathed form, quartz-sheathed form and silica-sheathed form.

14. An oven including a cavity, an electric heater provided in the cavity and a flue arrangement for venting the cavity, the electric heater comprising a dish-like support having a heating element provided therein, the heating element being provided at least in part with a coating of a catalyst means.

15. The oven of claim 14, wherein the heating element is provided at a wall of the cavity.

16. The oven of claim 15, wherein the wall of the cavity is a top wall of the cavity.

17. The oven of claim 14, wherein the flue arrangement is provided with a fan arrangement.

18. The oven of claim 14, wherein the electric heating element is located in the cavity of the oven adjacent to or overlying the flue arrangement.

19. The oven of claim 18, wherein the coating of the catalyst means is provided on at least a part of the heating element adjacent to or overlying the flue arrangement.

20. The oven of claim 14, wherein the dish-like support has a first face arranged to be open to the cavity of the oven and a second face having an aperture for interfacing with the flue arrangement.

21. The oven of claim 20, wherein the aperture in the dish-like support is provided in the second face of the dish-like support selected from a base and a peripheral wall of the dish-like support.

22. The oven of claim 20, wherein a base layer of thermal insulation material is arranged in the dish-like support, the heating element being supported on or adjacent to the base layer.

23. The oven of claim 22, wherein the base layer of thermal insulation material has an opening therein coinciding with the aperture in the dish-like support.

24. The oven of claim 23, arranged with at least one part of the heating element traversing the opening in the base layer coinciding with the aperture in the dish-like support, the aperture being provided in the base of the dish-like support.

25. The oven of claim 24, wherein a supporting member is arranged in the opening in the base layer for supporting the at least one part of the electric heating element traversing the opening in the base layer.

26. The oven of claim 25, wherein the supporting member is moulded into, or pressed into, the base layer of thermal insulation material.

27. The oven of claim 14, wherein at least one apertured member is provided, overlying the first face of the dish-like support and spaced from the heating element and permeable to smoke or fumes generated in the cavity of the oven.

28. The oven of claim 27, wherein the at least one apertured member overlies a peripheral wall of the dish-like support.

29. The oven of claim 28, wherein the at least one apertured member comprises a material selected from woven glass filament material, woven ceramic filament material, wire mesh material, and mixtures thereof.

* * * * *